US005511978A

United States Patent [19]

Sellers, Jr. et al.

[11] Patent Number: 5,511,978

[45] Date of Patent: Apr. 30, 1996

[54] EXPLOSION SIMULATOR AND SYSTEM FOR GENERATING AUDIO AND VISUAL EFFECTS

[75] Inventors: John W. Sellers, Jr., Spring Valley; Stanley E. Tate, Kettering, both of Ohio

[73] Assignee: Spectra Research, Inc., Dayton, Ohio

[21] Appl. No.: 210,475

[22] Filed: Mar. 21, 1994

[51] Int. Cl.[6] ..... F41A 33/04

[52] U.S. Cl. ..... 434/11; 472/64

[58] Field of Search ..... 434/11; 446/24, 446/220; 472/56, 64; 124/55, 59, 56, 1

[56] References Cited

U.S. PATENT DOCUMENTS

| | | | |
|---|---|---|---|
| 2,324,359 | 7/1943 | Callan | 446/24 |
| 3,238,642 | 3/1966 | Öhlund | 472/64 X |
| 4,114,080 | 9/1978 | Greenwood | 472/64 X |
| 4,245,403 | 1/1981 | Hipp | 472/64 X |
| 5,240,450 | 8/1993 | Graham | 434/11 X |

OTHER PUBLICATIONS

Photographs of 1988 Cannon.
Pp. 1 & 2 of SBIR Topic No. A92–097.

*Primary Examiner*—Gene Mancene
*Assistant Examiner*—Jeffrey A. Smith
*Attorney, Agent, or Firm*—Killworth, Gottman, Hagan & Schaeff

[57] ABSTRACT

An explosion simulator generates bang, smoke and flash cues. Pressurized gas is released into a shock tube to generate a shock wave and, thereby produce the bang cue. The pressurized gas is released from a gas reservoir into the shock tube through a diaphragm which is broken by a firing pin in response to a control circuit. A smoke powder packet containing a smoke powder is positioned in the shock tube. The pressurized gas travelling in the shock tube bursts the smoke powder packet and the smoke powder is dispersed to produce a smoke cue, or cloud. A flashtube generates the flash cue to illuminate the smoke cloud. An audio/visual explosion simulation system is also disclosed for generating multiple bang, smoke and flash cues from a single shock tube. Immediately prior to generating a bang cue, a gas supply fills a gas reservoir with pressurized gas. A reusable valve opens to release the pressurized gas from the reservoir into the shock tube and closes to seal the reservoir for refilling by the gas supply. A smoke generator repeatedly releases smoke powder into the shock tube to generate smoke clouds for each successive smoke cue.

21 Claims, 3 Drawing Sheets

EXPLOSION SIMULATOR AND SYSTEM FOR GENERATING AUDIO AND VISUAL EFFECTS

The U.S. Government has a paid-up license in this invention and the right in limited circumstances to require the patent owner to license others on reasonable terms as provided for by the terms of Contract No. M67004-93-C-0037 awarded by the U.S. Army.

BACKGROUND OF THE INVENTION

The present invention relates generally to explosion simulators for generating bang, smoke and flash cues and, more particularly, to a non-pyrotechnic explosion simulator and a multiple-cue system which uses a gas-driven shock tube to generate the bang cue, a non-toxic, environmentally safe powder to generate the smoke cue and a flash tube to generate the flash cue. The present invention is relatively safe to nearby personnel, is substantially harmless to the environment and is inexpensive compared to prior pyrotechnic explosion simulators.

Explosion simulators have been used in numerous military and commercial applications, such as military training, intrusion alarms, diversion devices (stun grenades), bird repelling noisemakers and stage effects. The military has employed explosion simulators during tactical engagement training to simulate explosions, such as from incoming artillery rounds. For such military applications, explosion simulators generate bang, smoke and flash cues in response to electrical signals from an electronic scoring system. During engagement training, the explosion simulators warn nearby units of an attack and indicate the strike locations of the artillery rounds to the attacking forces. An explosion simulator should consequently provide bang, smoke and flash cues which are detectable by personnel under a variety of conditions, such as high winds or dense foliage. However, the explosion simulator must provide these cues while not representing a safety hazard to nearby personnel.

Present explosion simulators discharge pyrotechnics to generate bang, smoke and flash cues. The explosive nature of pyrotechnics require that relatively extensive and time-consuming safety precautions be followed during storage, handling and discharge of the explosion simulators. Unfortunately, failure to follow the proper safety precautions may result in an unintentional discharge of the explosion simulator and, possibly, cause serious injury to nearby personnel or damage the nearby environment.

It is thus apparent that a need exits for a non-pyrotechnic explosion simulator and an explosion simulation system which provides bang, smoke and flash cues identifiable over a considerable distance, is relatively safe to nearby personnel, relatively environmentally safe and less expensive than prior pyrotechnic explosion simulators.

SUMMARY OF THE INVENTION

This need is met by the explosion simulator of the present invention wherein pressurized gas is released into a shock tube to generate a bang cue. In a basic device, the pressurized gas is stored in a gas reservoir having a gas outlet covered by a diaphragm. A firing pin and solenoid assembly is positioned in the gas reservoir for puncturing the diaphragm and releasing the pressurized gas through the gas outlet into the shock tube to generate the bang cue. A frangible smoke powder packet is broken by the pressurized gas travelling in the shock tube and generates a smoke cloud substantially simultaneous with the bang cue. Additionally, a flash generator illuminates the smoke cloud in response to the release of the pressurized gas in the shock tube.

A multiple cue system is also provided. For repeated cues, a gas reservoir is resupplied with pressurized gas from a gas supply after each bang cue. During a bang cue, a fast-acting valve located at the gas outlet of the gas reservoir opens in response to a control circuit to release the pressurized gas into the shock tube. The valve then closes and the gas reservoir is refilled with pressurized gas from the gas supply. Multiple smoke clouds are generated by a smoke generator consisting of a powder reservoir which releases a smoke powder into the shock tube in response to the pressurized gas travelling therein.

In accordance with one aspect of the present invention, an explosion simulator comprises a shock tube coupled to a gas pressure assembly for releasing pressurized gas into the shock tube to generate a bang cue. A control circuit activates the gas pressure assembly to release the pressurized gas into the shock tube. Preferably, the bang cue has a peak sound pressure level of approximately 130 to 140 decibels and the pressurized gas has a gauge pressure of less than 80 pounds per square inch.

The gas pressure assembly includes a gas reservoir for storing the pressurized gas. The pressurized gas is released from the gas reservoir into the shock tube via a gas outlet. A gas release mechanism releases the pressurized gas through the gas outlet in response to the control circuit. The gas release mechanism may comprise a diaphragm for sealing the gas outlet and a puncture mechanism for puncturing the diaphragm to release the pressurized gas from the gas reservoir in response to the control circuit.

The puncture mechanism comprises a firing pin and a solenoid responsive to the control circuit for forcing the firing pin through the diaphragm, thereby puncturing the diaphragm and releasing the pressurized gas from the gas reservoir. A smoke generator may be provided for generating a smoke cloud, or smoke cue, substantially simultaneous with the bang cue in response to the pressurized gas released into the shock tube. Preferably, the smoke generator comprises a smoke powder packet filled with a smoke powder positioned within the shock tube. The pressurized gas travelling in the shock tube breaks the packet and ejects the powder from the tube to form the smoke cloud. Powders suitable for use in the smoke powder packets include various inorganic oxides, such as titanium dioxide and the like.

A flash generator coupled to the control circuit may be provided to illuminate the smoke cloud. The flash generator may comprise a flashtube, which may be a xenon flashtube, for generating light to illuminate the smoke cloud and a flash circuit activated by the control circuit and connected to the flashtube for activating the flashtube.

In accordance with another aspect of the present invention, an explosion simulation system for generating multiple cues is provided. The multiple explosion simulation system comprises a shock tube and a gas pressure assembly for storing pressurized gas and for releasing the pressurized gas into the shock tube to generate a bang cue in response to a gas activation signal. A gas supply supplies the pressurized gas to the gas pressure assembly in response to a fill signal. The gas supply contains enough pressurized gas to repeatedly supply the pressurized gas for multiple bang cues. A control circuit, connected to the gas pressure assembly and the gas supply, provides the gas activation signal to the gas pressure assembly to release the pressurized gas into the shock tube and provides the fill signal to the gas supply to supply the pressurized gas to the gas pressure assembly.

A smoke generator generates a smoke cloud substantially simultaneous with each of the bang cues in response to the pressurized gas released into the shock tube. The smoke generator comprises a powder reservoir coupled to the shock tube for storing a smoke powder and for releasing the powder into the shock tube in response to the pressurized gas released into,the shock tube. In addition, the smoke generator includes a smoke valve, coupled to the gas supply, the control circuit and the powder reservoir, for supplying the pressurized gas from the gas supply to the powder reservoir to release the smoke powder into the shock tube in response to the control circuit.

A flash generator coupled to the control circuit illuminates the smoke cloud.

The gas pressure assembly preferably comprises a gas reservoir for storing the pressurized gas received from the gas supply and a gas valve for releasing the pressurized gas from the gas reservoir in response to the gas activation signal. The gas valve may be, for example, a popper valve, a flapper valve, a rotary valve or the like.

Preferably, the gas supply comprises a high pressure tank for storing the pressurized gas. A reservoir fill valve releases the pressurized gas from the high pressure tank into the gas pressure assembly.

In accordance with yet another aspect of the present invention, a multiple explosion simulation system is provided for generating sequential multiple cues. The system includes a plurality of shock tubes and a plurality of gas pressure assemblies positioned in the housing. Each of the gas pressure assemblies are capable of releasing pressurized gas into at least one associated shock tube to generate a bang cue from the associated shock tube or tubes. A control circuit sequentially activates at least one of the plurality of gas pressure assemblies such that the pressurized gas is released into the associated shock tube or tubes to generate a corresponding sequence of bang cues.

A plurality of smoke generators coupled to the housing is provided to generate smoke clouds. Each of the smoke generators are capable of generating a smoke cloud substantially simultaneous with the bang cue produced by an associated one of the shock tubes. Preferably, the plurality of smoke generators comprise a frangible compartmentalized sheet defining a plurality of smoke packets filled with a smoke powder. The plurality of smoke packets are formed to be aligned with and received by the plurality of shock tubes.

It is thus a feature of the present invention to provide an improved explosion simulator which uses pressurized gas travelling through a shock tube to generate a bang cue in a relatively safe and inexpensive manner; to provide an improved explosion simulation system for generating multiple cues by repeatedly releasing pressurized gas through a single shock tube; and, to provide an improved multiple cue system for sequentially activating a plurality of shock tubes to generate a corresponding sequence of bang cues.

These and other features and advantages of the present invention will become apparent from the following detailed description, the accompanying drawings and the appended claims.

DETAILED DESCRIPTION OF THE INVENTION

Figure 1:
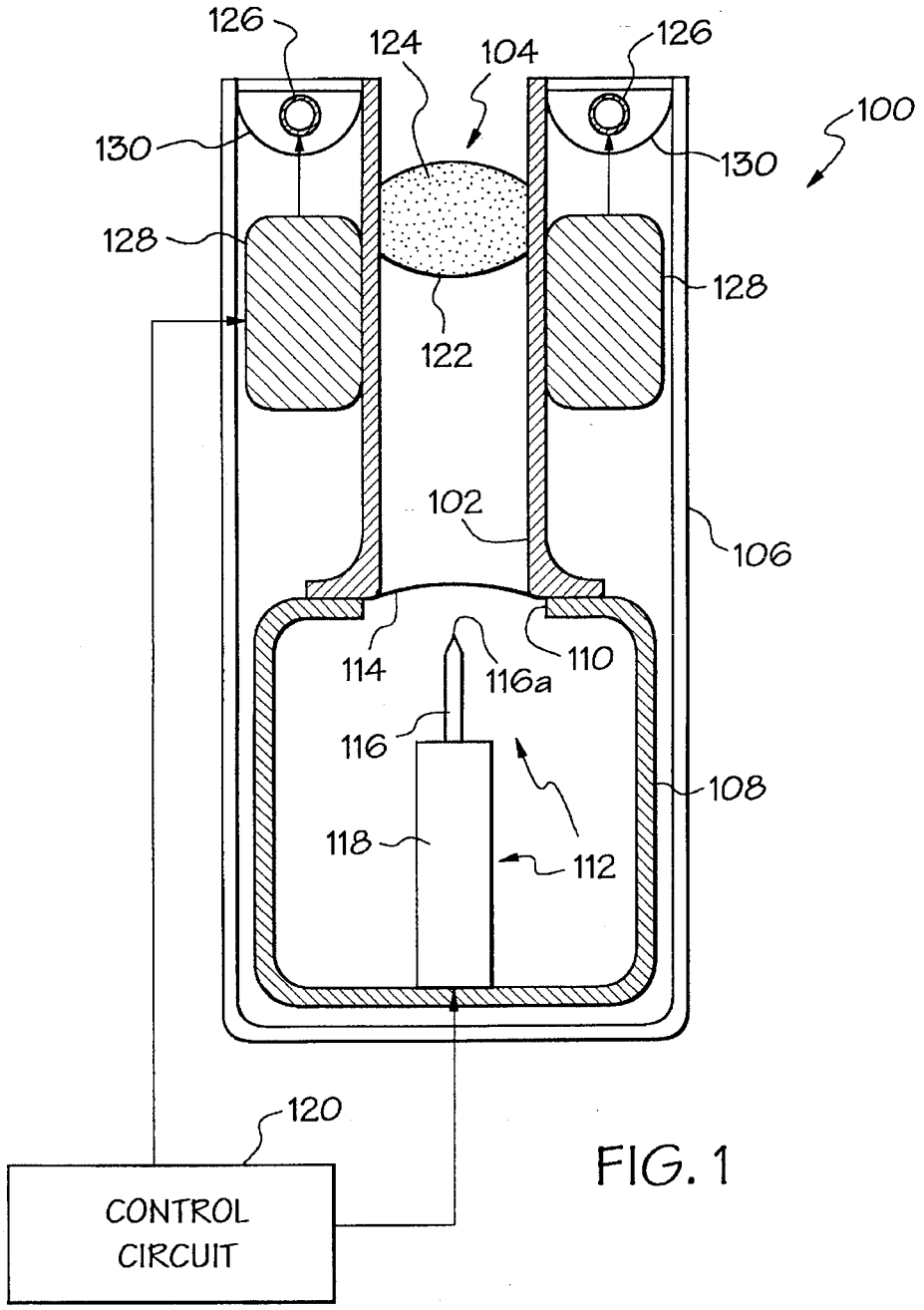
FIG. 1 is a longitudinal sectional view of an explosion simulator in accordance with one embodiment of the present invention including a control circuit and a firing pin.

An explosion simulator 100 including a shock tube 102 defining a central chamber 104 positioned in a housing 106 is shown in FIG. 1. Although the central chamber 104 will hereinafter be discussed as having a circular cross-section, it should be understood that other cross-section configurations, such as square or rectangular, may be advantageously used in the present invention.

The shock tube 102 is mounted on a gas reservoir 108 such that the central chamber 104 is aligned with a gas outlet 110 in the reservoir 108. The gas reservoir 108 stores pressurized gas, such as air, helium or the like, which is released through the gas outlet 110 into the central chamber 104 of the shock tube 102 by a gas release mechanism 112. The gas reservoir 108 and the gas release mechanism 112 comprise a gas pressure assembly. The gas release mechanism 112 preferably includes a diaphragm 114 which seals the gas outlet 110 to contain the pressurized gas in the gas reservoir 108 and a puncture mechanism for puncturing the diaphragm 114 to release the pressurized gas into the central chamber 104 of the shock tube 102. A diaphragm made of cold rolled, steel shim stock having a thickness in the range of 0.001–0.003 inch has been successfully used in a working embodiment of the present invention.

Figure 1A:
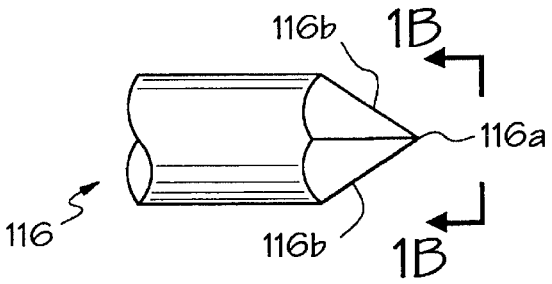
FIG. 1A is detailed view of the head of the firing pin shown in FIG. 1.
Figure 1B:
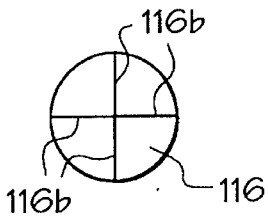
FIG. 1B is a front view of the puncture head of the firing pin shown in FIG. 1A taken along view line B—B.

The puncture mechanism includes a movable firing pin 116 having a puncture head **116*a* shown in detail in FIGS. 1A and 1B. As shown in the figures, the puncture head 116*a* preferably has a pyramidal shape which defines four edges 116*b* for puncturing the diaphragm 114. The firing pin 116 is coupled to a conventional solenoid 118 which forces the puncture head 116*a* through the diaphragm 114. Due to the pyramidal shape of the puncture head 116*a*, the diaphragm 114 typically breaks along four cracks propagating along the edges 116*b* of the puncture head 116*a* radially from the tip of the puncture head 116*a* to the circumference of the diaphragm 114**.

The solenoid 118 is controlled by a control circuit 120 which activates the solenoid 118 in response to an operator or other control circuit, such as a timing circuit. A number of control circuits are known in the art which are suitable for activating the solenoid 118. Since the structure and philosophy of the control circuit 120 are not important to the present invention beyond activating the solenoid 118, they will not be described herein.

As the pressurized gas rapidly exits the gas reservoir 108, a shock wave is formed in the shock tube 102. A quantity of high-pressure, high-temperature driven gas is generated immediately behind the shock wave, as the wave traverses the central chamber 104 of the shock tube 102. The driven gas is generally air that was in the shock tube before the release of the pressurized gas. The shock wave and the driven gas are expelled from the shock tube 102 at a high velocity to produce a bang cue.

A bang cue having a peak sound pressure level of approximately 140 decibels (dB) measured from a distance of two meters was experimentally produced by the present invention with pressurized air having a gauge pressure of 2.0 atmospheres (30 PSI) in a cylindrical shock tube having a 3 inch inner diameter. In addition, a bang cue having a peak sound pressure level of approximately 140 dB measured at a distance of two meters was produced by pressurized air having a gauge pressure of 2.7 atmospheres (40 PSI) in a cylindrical shock tube having a 1.5 inch inner diameter. It is contemplated that a bang cue having a peak sound pressure level of approximately 120–180 dB measured at a distance of two meters can be generated.

The pressurized gas is preferably supplied to the gas reservoir 108 just prior to producing the bang cue. For example, a conventional air compressor may supply the pressurized gas to the gas reservoir 108 in response to the control circuit 120 immediately prior to releasing the pressurized gas into the shock tube 102. Furthermore, a warning device, such as may be generated by a conventional siren or whistle, may be coupled to the device 100 for generating a warning signal in response to pressurization of the gas reservoir 108.

A smoke generator consisting of a smoke powder packet 122 containing a smoke powder 124 is positioned within the central chamber 104 of the shock tube 102 for generating a smoke cloud substantially simultaneous with the bang cue. It is contemplated that the smoke powder packet 122 would be made from polyethylene film which would substantially protect the smoke powder from rain and atmospheric humidity. The pressurized gas travelling in the shock tube 102 bursts the smoke powder packet 122 and the smoke powder 124 is dispersed into the air to produce a smoke cloud. The smoke powder 124 may be any one, or combination, of a number of suitable materials. However, in accordance with the Mie scattering theory, the optimum particle size of the smoke powder 124 is approximately equal to the wavelength of light, or 0.5–1.0 μm. In addition, the powder 124 should be nonflammable and relatively nontoxic.

Inorganic oxide powders are preferred as smoke powders since they are substantially environmentally safe, nonflammable, nontoxic and relatively inexpensive. In addition, different inorganic oxides produce different colored smoke clouds. For example, titanium oxide and talc produce white smoke clouds. Iron oxide can be obtained in either red, orange, yellow, brown or black.

A flash generator is provided for illuminating the smoke cloud generated by the smoke generator in response to the control circuit 120. The flash generator comprises a conventional flashtube 126, such as a xenon flashtube, and a flash circuit 128, which is coupled to the control circuit 120, for activating the flashtube 126. Since the flash circuit may be readily configured by one skilled in the art using conventional electrical components, it will not be further described herein. A reflective surface 130 may be provided to reflect the light generated by the flashtube 126 toward the smoke cloud.

Information may be transmitted by the explosion simulator to remote personnel by the color of the smoke cloud. For instance, the color of the smoke cloud may indicate which type of ordnance has exploded.

Figure 2C:
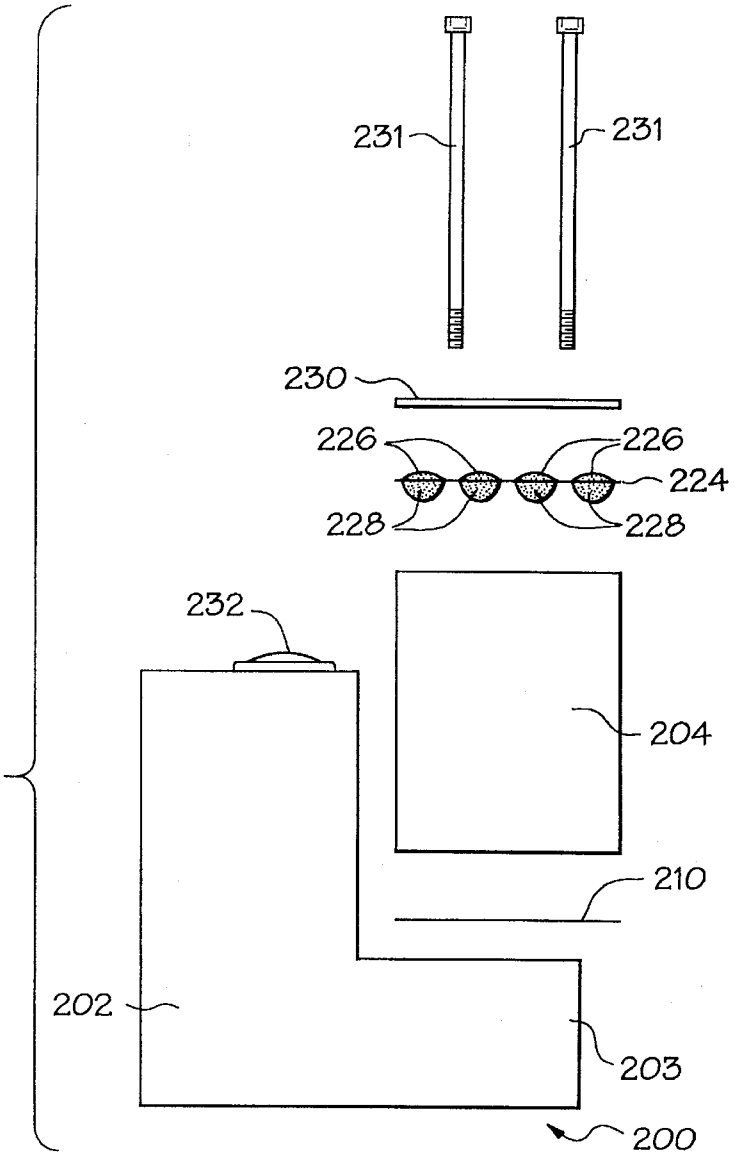
FIG. 2C is a side, partially exploded view of the multiple explosion simulation system shown in FIG. 2A.
Figure 2B:
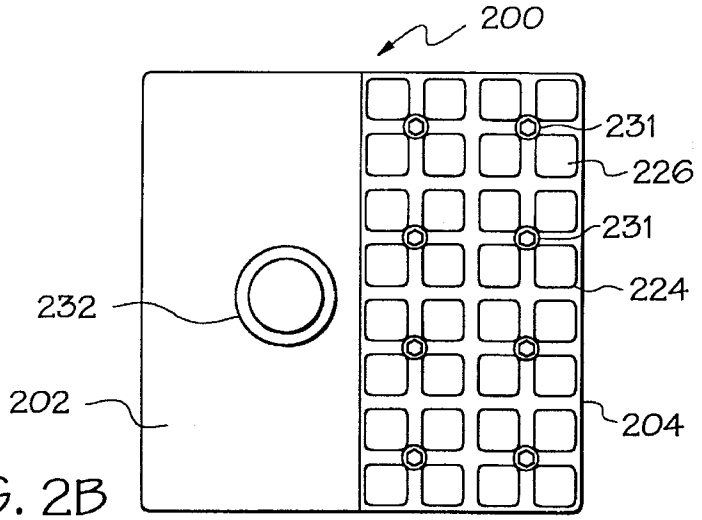
FIG. 2B is a top view of the multiple explosion simulation system shown in FIG. 2A.
Figure 2A:
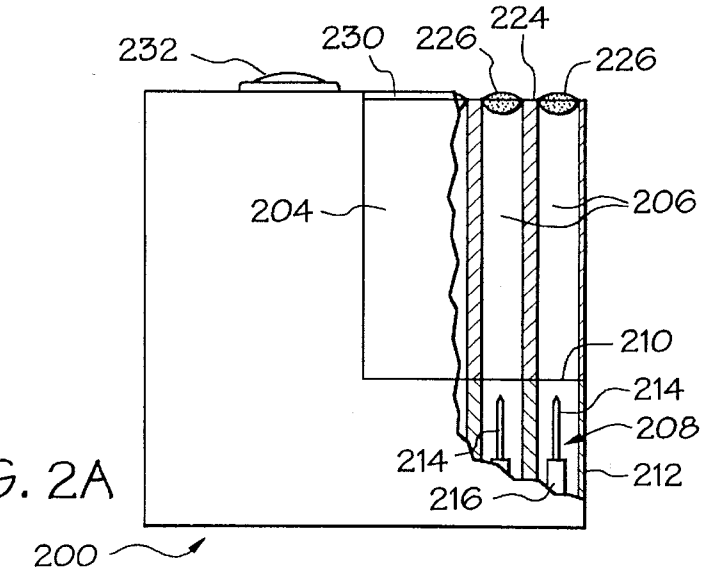
FIG. 2A is a side, partially cutaway view of a multiple explosion simulation system in accordance with a second embodiment of the present invention.

A compact multiple explosion simulation system 200 in accordance with a second embodiment of the present invention is shown in FIGS. 2A through 2C. The explosion simulation system 200 consists of a housing 202 having a lower section 203 and a shock tube compartment 204 in which a plurality of shock tubes 206 are positioned. To conserve space, substantially square shock tubes 206 are used. A plurality of gas pressure assemblies 208 are mounted in the housing 202 and coupled to the shock tubes 206. Each of the gas pressure assemblies 208 is capable of releasing pressurized gas into an associated one of the shock tubes 206 to generate a bang cue. Each of the shock tubes 206 and its associated gas pressure assemblies 208 operate in a manner substantially as described above with respect to the explosion simulator 100. A pressurized gas device, such as a conventional air compressor, may release pressurized gas into one or more of the gas pressure assemblies 208 immediately prior to activation of the one or more gas pressure assemblies 208.

A control circuit (not shown) sequentially activates one or more of the gas pressure assemblies 208 to release the pressurized gas into the associated one or more shock tubes 206 and generate a corresponding sequence of bang cues. The number of the gas pressure assemblies 208 concomitantly activated can be varied to transmit information to remote personnel, such as the type of artillery being fired.

Each of the gas pressure assemblies 208 comprises a diaphragm 210 for sealing a gas reservoir 212, a firing pin 214 and a solenoid 216 for forcing the firing pin 214 through the diaphragm 210 to release the pressurized gas into the associated shock tube 206. For ease of manufacture and assembly of the system 200, the diaphragms 210 for the gas assemblies 208 are formed into a sheet which is easily positioned between the gas reservoirs 212 and the shock tubes 206.

When assembling the explosion simulation system 200, the sheet of diaphragms 210 is superposed on the gas reservoirs 212. The shock tube compartment 204 is placed over the sheet of diaphragms 210 on the gas reservoirs 212. A plurality of smoke generators are coupled to the shock tubes 206 to generate a smoke cloud substantially simultaneous with a bang cue produced by an associated one of the shock tubes 206.

Preferably, the smoke generators comprise a frangible compartmentalized sheet 224 which defines a plurality of smoke powder packets 226 filled with smoke powder 228. When the sheet 224 is superposed on the shock tube compartment 204, each of the smoke powder packets 226 is aligned with and received by an associated shock tube 206. Different smoke powders can be used in the smoke powder packets 226 to create different colored smoke clouds. Consequently, pressurized gas travelling in any one or more of the shock tubes 206 breaks the associated one or more smoke powder packets 226 to produce the desired smoke cloud.

A waterproof cover sheet 230 further insulates the smoke powder 228 from humidity and dirt. The cover sheet 230 is broken by the shock wave travelling through any of the shock tubes 206. Alternatively, the smoke powder packets may be made of a waterproof material, thus alleviating the need for the cover sheet 230. The diaphragm 210, the shock tube compartment 204, the compartmentalized sheet 224 and the cover sheet 230 are then securely fastened to the housing 202 via a plurality of bolts 231. As one skilled in the art will readily comprehend, the housing 202 has corresponding threaded openings (not shown) therein for receiving the bolts 231. In addition, the diaphragm 210, the shock tube compartment 204, the compartmentalized sheet 224 and the cover sheet 230 contain apertures (not shown) for receiving the bolts 231. A single flashtube 232 illuminates the generated smoke clouds in the manner described above.

Figure 3:
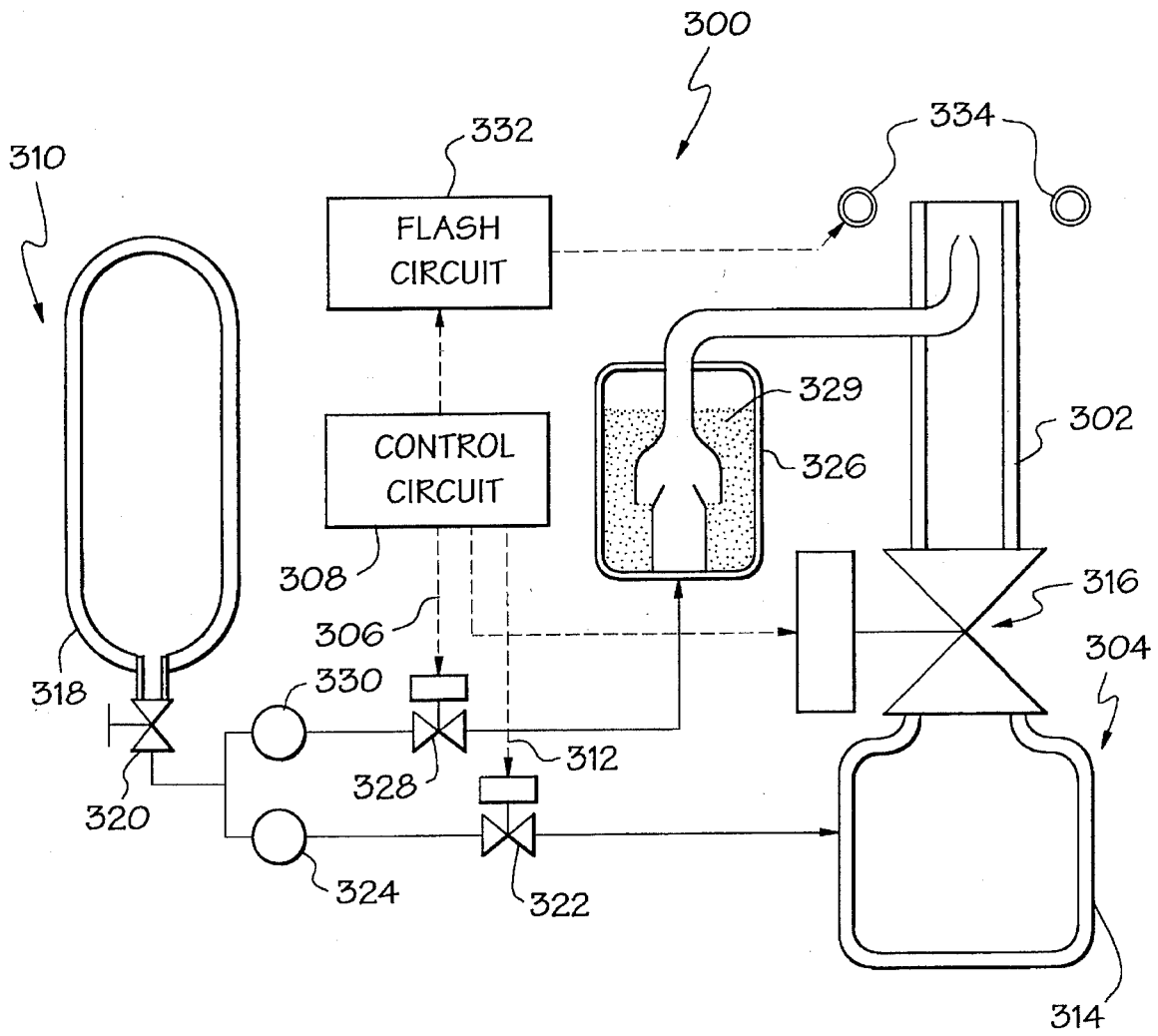
FIG. 3 is a schematic diagram of an explosion simulation system for generating multiple cues in accordance with a third embodiment of the present invention.

An explosion simulation system 300 for generating multiple cues in a single shock tube 302 is shown in FIG. 3. The shock tube 302 is coupled to a gas pressure assembly 304 which the pressurized gas and releases the gas into the shock tube 302 to generate a bang cue. The gas pressure assembly 304 releases the pressurized gas into the shock tube 302 in response to a gas activation signal, represented by a dashed line 306, generated by a control circuit 308.

Immediately prior to generating another bang cue, a gas supply 310 supplies additional pressurized gas to the gas pressure assembly 304. A pre-firing warning may be generated upon supplying the pressurized gas to the gas pressure assembly 304. The gas supply 310 preferably contains, or generates, a quantity of pressurized gas sufficient to refill the gas pressure assembly 304 for a series of bang cues. The gas supply 310 releases pressurized gas into the gas pressure assembly 304 in response to a fill signal, represented by a dashed line 312, from the control circuit 308.

The gas pressure assembly 304 includes a gas reservoir 314 for storing pressurized gas and for receiving additional pressurized gas from the gas supply 310. A gas valve 316 is interposed between the gas reservoir 314 and the shock tube 302 which opens to release the pressurized gas into the shock tube 302 in response to the gas activation signal 306. Preferably, the gas valve 316 comprises a fast-acting, reusable valve, such as a popper valve, a flapper valve, a rotary valve or the like. Since each of these valves, when open, partially obstruct the shock tube 302, the shock tube 302 preferably has a greater inner diameter around the gas valve 316 such that the pressurized gas has a constant cross-sectional area, as it travels through the shock tube 302.

The gas supply 310 includes a high pressure tank 318 which stores the pressurized gas used to refill the gas reservoir 314. It should be understood, however, that an air compressor device may also be used to supply pressurized gas in the system 300. A main valve 320 controls the primary flow of pressurized gas from the tank 318. A reservoir fill valve 322 controls the flow of the pressurized gas to the gas reservoir 314 in response to the fill signal 312. A conventional regulator 324 regulates the flow of the pressurized gas into the gas reservoir 314.

A smoke generator, which includes a powder reservoir 326 and smoke valve 328, releases a smoke powder 329 into the shock tube 302 immediately prior to releasing the pressurized gas into the tube 302 to generate a smoke cloud substantially simultaneous with the bang cue. The smoke generator may continue to release the smoke powder 329, preferably at a reduced pressure, into the shock tube 302 for several seconds after the bang cue to produce a smoke cloud trail. The powder reservoir 326 stores the smoke powder 329 which is released into the shock tube 302 when the pressurized gas is released into the shock tube.

The pressurized gas from the high pressure tank 318 is used to transport the smoke powder into the shock tube 302. The smoke generator shown in FIG. 3 operates in a manner which is similarly used in sand blasters and garden dusters. Basically, the pressurized gas collects a portion of smoke powder 329 and transports the portion into the shock tube 302.

The smoke valve 328 is interposed between the high pressure tank 318 and the powder reservoir 326 to control the flow of pressurized gas into the powder reservoir 326 in response to the control circuit 308. A conventional regulator 330 is inserted between the smoke valve 328 and the high pressure tank 318 to regulate the flow of gas into the powder reservoir 326. Although using the pressurized gas to transport the smoke powder into the shock tube is preferred, it should be understood that any device which releases a portion of the smoke powder into the shock tube may be advantageously used in the present invention.

A flash circuit 332 responsive to the control circuit 308 activates a flashtube 334 to illuminate the smoke cloud. The flashtube 334 is preferably a xenon flashtube, however, any suitable light generator may be employed.

Having thus described the invention in detail by way of reference to preferred embodiments thereof, it will be apparent that other modifications and variations are possible without departing from the scope of the invention defined in the appended claims.

What is claimed is:

1. An explosion simulator comprising:

a shock tube;

a gas pressure assembly coupled to said shock tube and comprising a gas reservoir for storing pressurized gas and a gas release mechanism for releasing said pressurized gas into said shock tube to generate a bang cue, said gas release mechanism comprising a diaphragm for sealing a gas outlet of said gas reservoir and a puncture mechanism mounted adjacent to said diaphragm for puncturing said diaphragm to release said pressurized gas from said gas reservoir; and a control circuit connected to said gas pressure assembly for activating said gas puncture mechanism such that said pressurized gas is released into said shock tube to generate said bang cue.

2. The explosion simulator as recited in claim 1 wherein said bang cue has a peak sound pressure level of approximately 120 to 180 decibels measured at a distance of about two meters.

3. The explosion simulator as recited in claim 2 wherein said pressurized gas has a gauge pressure of less than 80 pounds per square inch.

4. The explosion simulator as recited in claim 1 wherein said puncture mechanism comprises:

a firing pin positioned adjacent to said diaphragm; and a solenoid coupled to said firing pin and responsive to said control circuit for forcing said firing pin against said diaphragm to puncture said diaphragm and release said pressurized gas from said gas reservoir when activated by said control circuit.

5. The explosion simulator as recited in claim 1 further comprising a smoke generator coupled to said shock tube for generating a smoke cloud substantially simultaneous with said bang cue in response to said pressurized gas released into said shock tube.

6. The explosion simulator as recited in claim 5 wherein said smoke generator comprises a smoke powder packet positioned within said shock tube, said smoke powder packet being filled with a smoke powder which is dispersed to produce said smoke cloud by said pressurized gas travelling in said shock tube.

7. The explosion simulator as recited in claim 6 wherein said smoke powder is an inorganic oxide.

8. The explosion simulator as recited in claim 6 further comprising a flash generator coupled to said control circuit for illuminating said smoke cloud.

9. The explosion simulator as recited in claim 8 wherein said flash generator comprises:

a flashtube for generating light to illuminate said smoke cloud; and a flash circuit activated by said control circuit and connected to said flashtube for activating said flashtube.

10. The explosion simulator as recited in claim 9 wherein said flashtube is a xenon flashtube.

11. An explosion simulation system for generating multiple cues comprising:

a shock tube;

a gas pressure assembly coupled to said shock tube and comprising a gas reservoir for storing pressurized gas and a gas poppet valve for releasing said pressurized gas into said shock tube to generate a bang cue in response to a gas activation signal;

a gas supply coupled to said gas reservoir for supplying said pressurized gas to said gas reservoir of said gas pressure assembly in response to a fill signal, said gas supply being capable of repeatedly supplying said pressurized gas for multiple bang cues; and a control circuit, connected to said gas pressure assembly and said gas supply, for providing said gas activation signal to said gas pressure assembly to release said pressurized gas into said shock tube and for providing said fill signal to said gas supply to supply said pressurized gas to said gas reservoir of said gas pressure assembly.

12. The explosion simulation system as recited in claim 11 further comprising a smoke generator coupled to said shock tube for generating a smoke cloud substantially simultaneous with said bang cue in response to said pressurized gas released into said shock tube.

13. The explosion simulation system as recited in claim 12 further comprising a flash generator coupled to said control circuit for illuminating said smoke cloud.

14. The explosion simulation system as recited in claim 12 wherein said smoke generator comprises a powder reservoir coupled to said shock tube for storing a smoke powder and for releasing said smoke powder into said shock tube in response to said pressurized gas released into said shock tube.

15. The explosion simulation system as recited in claim 14 wherein said smoke generator further comprises a smoke valve, coupled to said gas supply, said control circuit and said powder reservoir, for supplying said pressurized gas from said gas supply to said powder reservoir to release said smoke powder into said shock tube in response to said control circuit.

16. The explosion simulation system as recited in claim 11 wherein said gas supply comprises:

a high pressure tank for storing said pressurized gas; and a reservoir fill valve, said high pressure tank being coupled to said gas reservoir through said fill valve which is operable for releasing said pressurized gas from said high pressure tank into said gas reservoir of said gas pressure assembly.

17. An explosion simulation system for generating multiple cues comprising:

a shock tube;

a gas pressure assembly coupled said shock tube and comprising a gas reservoir for storing pressurized gas and a gas flapper valve for releasing said pressurized gas into said shock tube to generate a bang cue in response to a gas activation signal;

a gas supply coupled to said gas reservoir for supplying said pressurized gas to said gas reservoir of said gas pressure assembly in response to a fill signal, said gas supply being capable of repeatedly supplying said pressurized gas for multiple bang cues; and a control circuit, connected to said gas pressure assembly and said gas supply, for providing said gas activation signal to said gas pressure assembly to release said pressurized gas into said shock tube and for providing said fill signal to said gas supply to supply said pressurized gas to said gas reservoir of said pressure assembly.

18. An explosion simulation system for generating multiple cues comprising:

a shock tube;

a gas pressure assembly coupled to said shock tube and comprising a gas reservoir for storing pressurized gas and a gas rotary valve for releasing said pressurized gas into said shock tube to generate a bang cue in response to a gas activation signal;

supply coupled to said gas reservoir for supplying said pressurized gas to said gas reservoir of said gas pressure assembly in response to a fill signal, said gas supply being capable of repeatedly supplying said pressurized gas for multiple bang cues; and a control circuit, connected to said gas pressure assembly and said gas supply, for providing said gas activation signal to said gas pressure assembly to release said pressurized gas into said shock tube and for providing said fill signal to said gas supply to supply said pressurized gas to said gas reservoir of said gas pressure assembly.

19. A multiple explosion simulation system comprising:

a housing;

a plurality of shock tubes positioned in said housing;

a plurality of gas pressure assemblies positioned in said housing adjacent to and associated with said plurality of shock tubes, each of said gas pressure assemblies being capable of releasing pressurized gas into at least one of said shock tubes associated therewith to generate a bang cue from said associated at least one shock tube; and a control circuit connected to said plurality of gas pressure assemblies for sequentially activating at least one of said plurality of said gas pressure assemblies such that said pressurized gas is released into associated shock tubes to generate a corresponding sequence of bang cues.

20. The multiple explosion simulation system as recited in claim 19 further comprising a plurality of smoke generators coupled to said housing and associated with said shock tubes, said smoke generators being capable of generating smoke clouds substantially simultaneous with said bang cues.

21. The multiple explosion simulation system as recited in claim 20 wherein said plurality of smoke generators comprises a frangible compartmentalized sheet defining a plurality of smoke powder packets filled with a smoke powder and corresponding to said plurality of shock tubes, said plurality of smoke powder packets being aligned with and received by said plurality of shock tubes.

* * * * *

UNITED STATES PATENT AND TRADEMARK OFFICE

CERTIFICATE OF CORRECTION

PATENT NO. : 5,511,978

DATED : April 30, 1996

INVENTOR(S) : Sellers, Jr., et al.

It is certified that error appears in the above-indentified patent and that said Letters Patent is hereby corrected as shown below:

Column 9, line 58, "coupled said shock tube" should read --coupled to said shock tube--.

Column 10, line 11, "said pressure" should read --said gas pressure--;

Column 10, line 21, "supply" should read --a gas supply--.

Signed and Sealed this

Fifteenth Day of October, 1996

*Attest:*

Bruce Lehman

BRUCE LEHMAN

*Attesting Officer*

*Commissioner of Patents and Trademarks*